United States Patent [19]

Perry

[11] 4,096,664

[45] Jun. 27, 1978

[54] SEAL TIGHT DOOR FOR WAREWASHER

[75] Inventor: Kenneth E. Perry, Wellesley, Mass.

[73] Assignee: Adamation, Inc., Newton, Mass.

[21] Appl. No.: 743,932

[22] Filed: Nov. 22, 1976

[51] Int. Cl.[2] ..... E05D 15/56

[52] U.S. Cl. ..... 49/235; 49/472; 312/229

[58] Field of Search ..... 49/209, 225, 234, 235, 49/472–474, 409; 312/229, 335, 341 R

[56] References Cited

U.S. PATENT DOCUMENTS

| | | | |
|---|---|---|---|
| 433,256 | 7/1890 | Phipps | 49/234 |
| 2,340,014 | 1/1944 | Nystrom | 49/234 X |
| 2,937,063 | 5/1960 | Kahn | 312/229 |

*Primary Examiner*—Kenneth Downey

*Attorney, Agent, or Firm*—Richard L. Stevens

[57] ABSTRACT

A horizontally sliding seal tight door is provided for a warewasher. The leading and trailing edges of the door are formed to mate with guide members secured to the sides of the door opening. When in the closed position the edges of the door in combination with the guide members direct the water contacting the door into the warewasher.

4 Claims, 2 Drawing Figures

SEAL TIGHT DOOR FOR WAREWASHER

BACKGROUND AND BRIEF SUMMARY OF THE INVENTION

In commercial warewashers the steps followed in cleaning dishes, flatware, glasses, etc., generally include placing the wares in a rack and placing the rack in a dolly or on a conveyor. The operator usually prerinses the wares with a manually operated flexible spray nozzle. The rack then travels through a prewash zone, a wash zone, a prerinse zone and a rinse zone, and subsequently travels to an unloading station. These zones are enclosed in a housing which comprises inner and outer walls and a top. The bottom is a conveyor pan or trough. The racks travel in a circular or arcuate path.

It is not uncommon for some machines to malfunction and correcting the malfunction requires entry into the housing. Malfunctions may be caused by such occurrences as the wares being dislodged, jamming of the conveyor or dollies or necessary adjustments to valves and nozzles.

The high pressure sprays used in the zones necessitate a housing which is fairly tight to prevent the sprayed waters from contacting an operator and/or flooding the area. If all portions of the housing are firmly secured, this will prevent any possibility of flooding, although much time is lost through downtime in removing the panels. Most machines include movable or slidable doors or panels on the outer walls of a warewasher. Commonly, these doors move along a vertical axis in tracks and are counter balanced through a weight arrangement. It has been found that in the newer establishments employing warewashers that space is more and more at a premium and ceiling space or height is lower.

Horizontally sliding doors or panels have been proposed but difficulties have been encountered both in the short life of such doors and in sealing the door in such a manner that flooding of an area from the spraying of the nozzles is avoided.

The present invention provides a sliding door or panel for a warewasher which is uniquely adapted for a warewasher which door is rugged, dependable and more importantly, is configured such that when it is moved to a closed position it is effectively sealed as part of the housing.

The invention comprises a door carried on a cammed rail which door reciprocates between an open and a closed sealing position. The door frame which is formed on the housing wall includes vertical door guides which define the sides of the door frame. The edges of the door are shaped to mate with the door guides, the edges and the guides being shaped to direct the flow of water into the housing. The bottom edge of the door is formed to direct the water to a fish mouth sill which extends across the inside bottom of the door frame.

To open the door it is raised upwardly traveling on cammed surfaces and then moved horizontally to either side until open. In closing the door it is moved in the opposite direction and rides over the cams and drops into sealing position.

Accordingly, a door is provided which allows easy access to the housing, does not require any additional space than that required by the basic warewasher, and closes in sealing engagement.

DESCRIPTION OF THE PREFERRED EMBODIMENT

Figure 1:
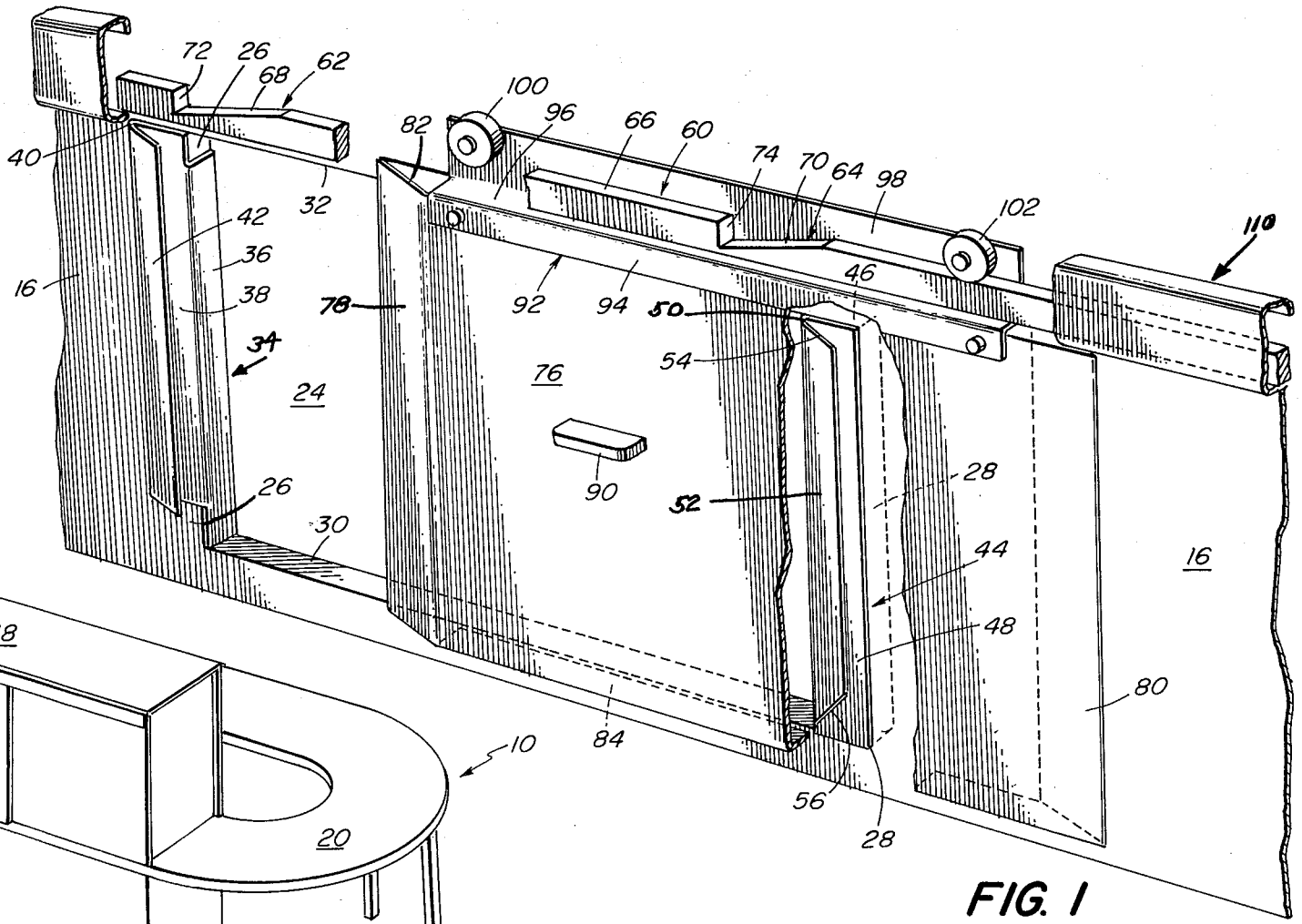
FIG. 1 is a front schematic illustration of a portion of a warewasher.

In FIG. 1 a portion of a commercial warewasher 10 is shown, such as an A-11 Warewasher, manufactured by Adamation, Inc. of Newton, Massachusetts. The warewasher 10 includes a frame 12, a housing 14 having an outer wall 16, a top 18 and a conveyor pan 20. A door assembly embodying the present invention is shown generally at 22.

Figure 2:
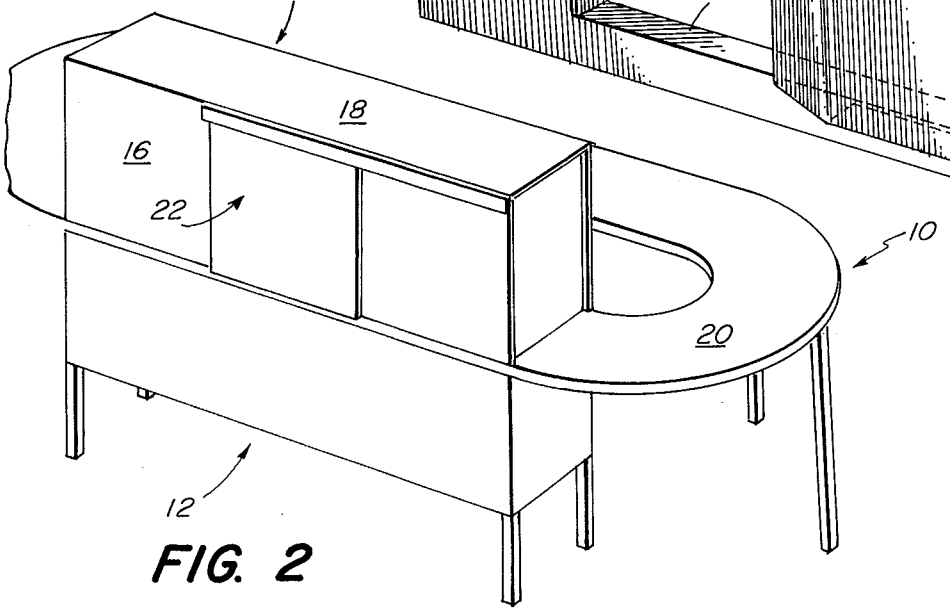
FIG. 2 is a perspective partly fragmentary view of a door embodying the present invention.

Referring to FIG. 2 the door assembly 22 is formed as part of the housing wall 16. More specifically when in its closed sealed position it forms one wall of the wash zone. A door opening 24 is defined by side flanges 26 and 28 extending perpendicularly and inwardly from the side wall 16; a bottom flange 30 extending slightly downwardly and inwardly from the side wall 16 and a top edge 32.

Secured to the side flange 26 such as by welding, is an integrally formed door guide 34. This door guide includes a flange 36 which abuts and is secured to the flange 26. A facing portion 38 is perpendicular to the flange 36 and abuts the housing wall 16. It is turned to form a reverse U-shaped bend 40 and extends rearwardly and outwardly to form a guide portion 42.

Secured to the side flange 28, such as by welding, is an integrally formed door guide 44. This door guide includes a flange 46 which abuts and is secured to the flange 28. A facing portion 48 is perpendicular to the flange 28 and is parallel to the wall 16. It is turned to form a reverse U-shaped bend 50 and extends rearwardly and outwardly to form a guide portion 52. The guide portion includes an upper edge 54 and a lower edge 56 which lower edge is directed upwardly and rearwardly and is not parallel to the upper edge 54.

A rail 60 having triangular shaped cams 62 and 64 and an upper rail surface 66 is fastened above, such as by bolting, and parallel to the top edge 32 of the door opening 24. The cams 62 and 64 both include upwardly sloping surfaces 68 and 70 respectively, which extend from the rail surface 66 and both include perpendicular jam surfaces 72 and 74. The cam 62 is aligned with guide 34 and the cam 64 is aligned with the guide 44. The total rail length is at least twice the width of the door 22.

The door assembly 22 comprising a front panel 76 having an inwardly and forwardly sloped leading edge 78 and an inwardly and forwardly sloped trailing edge 80 which edges mate when the door is in a closed position with the guides 34 and 44 respectively. The upper edge of the panel 76 includes a flange 82 which is perpendicular to the plane of the front panel and extends inwardly and also extends from the end of the edge 78 across the panel 76 to the end of the edge 80. The lower edge of the panel includes a flange 84 which is perpendicular to the plane of the panel and extends inwardly and slightly downwardly from the horizontal. The flange 84 extends from the end of the edge 80 and across the panel 76. The flange 84 does not extend across any portion of the edge 78. A handle 90 is provided for the opening and closing of the door and is secured to the panel 76.

A stair shaped door bracket 92 is fastened, such as by bolting, at a lower riser 94 to the panel 76. A tread 96 extends across the flange 82 and an upper riser 98 has two wheels 100 and 102 pinned thereto. The two wheels travel on the rail 60.

A U-shaped channel member 110 is secured, such as by bolting, to the wall 16. This member 110 prevents the door assembly 22, bracket 92, wheels 100, 102 combination from leaving the rail 60 as the door assembly travels between its open and closed positions.

The door as shown in FIG. 2, is in its open position. To close the door it is moved to the left, the wheels 100 and 102 traveling on the rail 60. As the door approaches the closed position the wheels 100 and 102 travel over the cams 62 and 64. More specifically, in moving to the closed position they travel on the sloping surfaces 68 and 72 and then abut the jam surfaces 72 and 74 of the cams 62 and 64. At this point, the door is in its closed sealed position. The leading edge 78 of the door is received in the guide 34. The trailing edge 80 is received in the guide 44. The upper flange 82 of the door 76 is simply received below the upper edge of the opening 24.

The lower flange 84 of the panel 76 is disposed above the lower flange 30 of the opening 24. The water generated in the wash zone primarily strikes the inner surface of the panel 76 and flows to both sides and downwardly. The configuration of the mated edges and guides, directs the flow inwardly toward the center of the door and through gravity it of course, flows downwardly primarily across the lower flange 84 of the panel 76 and into a sump. If desired, a fish mouth sill or other drainage structure may be used to carry the water from the lower flange 84.

The absence of a portion of the lower flange 84 forms an opening 85 on the panel 76, at the leading edge 78. This allows the door to be moved to its open position. When the door assembly 22 is raised, traveling on the surfaces 68, 70 this opening 85 clears the door guide 34.

To open the door from its closed position it is moved rightwardly the wheels 100 and 102 traveling upwardly on the surfaces 68 and 70 and rightwardly on the surface 66 until such time as the wheel 100 engages jam surface 74.

Although the invention has been described with specific reference to the door opening from left to right and closing from right to left it is apparent to those skilled in the art that the same basic concepts may be used if desired to open the door from left to right and close the door from right to left. Also the door when in its closed position may be designed to form the wall of one or more of the other zones in a warewasher, or only a portion of the wall of one of said zones.

Having described my invention, what I now claim is:

1. In a warewasher having a housing which housing includes an outer wall, the improvement which comprises:

(a) a door frame formed in the wall of the housing, the frame including side edges, a top edge and a lower edge;

(b) first guide means secured to one of said side edges, said guide means formed in a longitudinal substantially U-shaped configuration;

(c) second guide means secured to the other of said side edges and formed in a longitudinal substantially U-shaped configuration;

(d) a horizontal sliding door having a leading edge and a trailing edge and adapted to move between a closed position and an open position, the leading edge adapted to mate in sealing engagement with the first guide means and the trailing edge adapted to mate in sealing engagement with the second guide means such that any water contacting the edges of the door will be directed downwardly; a bottom flange extending across the door and extending inwardly and downwardly whereby water is directed from the combination of the guide means and leading and trailing edges inwardly into the housing; and, (e) a rail to support the door in a movable manner parallel to the upper edge of the door frame and including at least two stop cams, said cams disposed such that when the door is moved to the closed position the stop cams will prevent horizontal movement each of said cams substantially aligned with the first and second guide means respectively.

2. The warewasher of claim 1 wherein the bottom flange of the door does not contact the leading edge of the door and defines an opening therewith to facilitate the upward movement of the door when moving the door from the closed to the open position.

3. The warewasher of claim 1 which includes means to prevent the door from disengaging from the rail.

4. The warewasher of claim 1 wherein the rail length is at least twice the width of the door.

* * * * *